US006092506A

United States Patent [19]

Takagi et al.

[11] Patent Number: 6,092,506

[45] Date of Patent: Jul. 25, 2000

[54] THROTTLE VALVE CONTROLLER FOR AN INTERNAL COMBUSTION ENGINE

[75] Inventors: Katsunari Takagi; Kenji Nakao; Takeshi Sugiyama, all of Tokyo, Japan

[73] Assignee: Mitsubishi Denki Kabushiki Kaisha, Tokyo, Japan

[21] Appl. No.: 09/178,475

[22] Filed: Oct. 26, 1998

[30] Foreign Application Priority Data

May 27, 1998 [JP] Japan ..... 10-146295

[51] Int. Cl.[7] ..... F02D 1/00

[52] U.S. Cl. ..... 123/399; 745/345

[58] Field of Search ..... 123/399, 377; 745/345, 902

[56] References Cited

U.S. PATENT DOCUMENTS

| | | | |
|---|---|---|---|
| 3,081,648 | 3/1963 | Duer | 475/902 |
| 4,651,575 | 3/1987 | Morishita et al. | 475/345 |
| 4,712,451 | 12/1987 | Morishita et al. | 475/345 |
| 5,127,279 | 7/1992 | Barthruff | 475/345 |

FOREIGN PATENT DOCUMENTS

| | | | |
|---|---|---|---|
| 3531472 | 3/1986 | Germany | 475/345 |
| 82046 | 4/1986 | Japan | 475/345 |
| 6-65854 | 8/1994 | Japan . | |

*Primary Examiner*—John Kwon

*Attorney, Agent, or Firm*—Sughrue, Mion, Zinn Macpeak & Seas, PLLC

[57] ABSTRACT

A throttle valve controller for an internal combustion engine in which a ring gear comprises a core body having rigidity and a synthetic resin tooth portion integrated with the core body to improve the engagement accuracy of the ring gear and reduce costs.

10 Claims, 4 Drawing Sheets

THROTTLE VALVE CONTROLLER FOR AN INTERNAL COMBUSTION ENGINE

BACKGROUND OF THE INVENTION

1. Field of the Invention

The present invention relates to a throttle valve controller for an internal combustion engine, which transmits the revolution of a motor in accordance with the operation amount of an accelerator to the valve shaft of a throttle valve for controlling the amount of intake air for an internal combustion engine by means of a gear mechanism consisting of a sun gear, an internal tooth type gear ring and an epicyclic gear to be engaged with these gears.

2. Description of the Prior Art

FIG. 7 is a partially cutaway side view of a conventional throttle valve controller for an internal combustion engine. In FIG. 7, reference numeral 1 denotes an internal combustion engine, 2 a throttle valve, 3 a valve housing for the throttle valve 2, 4 an inlet passage for the valve housing 3, 5 a valve shaft rotatably attached to the valve housing 3 and extending through the inlet passage 4, 6 a valve body attached to the valve shaft 5, 7 an inlet pipe such as an inlet manifold for connecting the inlet passage 4 to an unshown inlet hole in the internal combustion engine 1, 8 a motor such as a DC brushless motor located adjacent to the throttle valve 2, 9 a motor housing for the motor 8, 10 a stator built in the motor housing 9, 11 a rotor to be paired with the stator 10, 12 an output shaft fitted with the rotor 11, 13 a bearing for rotatably connecting one end of the output shaft 12 to the motor housing 9, and 14 a terminal connected to the coil of the stator 10 and built in the motor housing 9. The motor 8 and the throttle valve 2 are located adjacent to each other in such a manner that the revolution center of the output shaft 12 and the revolution center of the valve shaft 5 are concentric to each other and located on a straight line L1 shown by a one-dotted chain line, the other end of the output shaft 12 and one end of the valve shaft 5 are opposed to each other with space therebetween, and the end face of the opening of the motor housing 9 formed annular around the other end of the output shaft 12 and the end face of the opening of the valve housing 3 formed annular around one end of the valve shaft 5 are arranged to face each other. While this throttle valve 2 and the motor 8 are located adjacent to each other, the gear mechanism 16 is placed in internal space 15 formed hermetically by the valve housing 3 and the motor housing 9. The gear mechanism 16 consists of a sun gear 17, an internal tooth type ring gear 18 and an epicyclic gear 19 to be engaged with these gears 17 and 18. The sun gear 17 revolves together with the output shaft 12 of the motor 2, and the revolution center of the sun gear 17 and the revolution center of the valve shaft are opposed and concentric to each other. The tooth portion 18*a* of the ring gear 18 is arranged around the sun gear 17 concentrically, and the center hole portion 18*b* of the ring gear 18 is connected to the output shaft 12 through the bearing 20 concentrically and rotatably. The ring gear 18 is fixed in the valve housing 2 and the motor housing 9 in such a manner that the outer peripheral surface 18*c* on the tooth portion 18*a* side of the ring gear 18 is in contact with the inner peripheral surface 3*a* of the valve housing 3 and the inner peripheral surface 9*a* of the motor housing 9 both of which form internal space 15. The revolution center of the epicyclic gear 19 is connected to a support body 21 fixed to one end of the valve shaft 5 through a support shaft 22 so that it can revolve together with the valve shaft 5. After the gear mechanism 16 is placed in the internal space 15, the valve housing 3 and the motor housing 9 are connected to each other by fixing tools such as unshown bolts. Reference numeral 23 denotes a control unit for supplying power to the terminal 14 of the motor 8, 24 an accelerator, and 25 an accelerator sensor for detecting the operation amount of the accelerator 24, converting the detected amount into an electric signal, and outputting the electric signal to the control unit 23. A structure similar to this prior art is disclosed by Examined Japanese Patent Publication No. 6-65854.

A description is given of this throttle valve controller. When the accelerator 24 is operated, the accelerator sensor 25 which has detected the operation amount of the accelerator 4 outputs an electric signal to the control unit 23 which in turn supplies power in accordance with the electric signal from the accelerator sensor 25 to the terminal 14 of the motor 8. The stator 10 generates a revolution magnetic field in accordance with power running in the coil of the stator 10 from the terminal 14. The output shaft 12 revolves by attraction and repulsion caused by the revolution magnetic field generated by the stator 10 and the magnetic field of the rotor 11, and the sun gear 17 revolves together with the output shaft 12. The epicyclic gear 19 revolves around the sun gear 17 and on the support shaft 22. The valve shaft 5 is revolved by the revolution of this epicyclic gear 19 through the support body 21. By this revolution of the valve body 6, the cross section of the inlet passage 4 is controlled. That is, the gear mechanism consisting of the sun gear 17, the ring gear 18 and the epicyclic gear 19 transmits the revolution of the motor 2 in accordance with the operation amount of the accelerator 24 to the valve shaft 5 of the throttle valve 2 for controlling the amount of intake air for the internal combustion engine 1 through the support body 21.

In the above throttle valve controller of the prior art, after the whole shape of the ring gear 18 including the tooth portion 18*a*, the center hole portion 18*b* and the outer peripheral surface 18*c* is formed by cold forging, the hole wall surface of the center hole portion 18*b* is finished by machining for engagement between the ring gear 18 and the bearing 20, and the outer peripheral surface 18*c* is finished by machining for engagement between the ring gear 18 and the inner peripheral surfaces 3*a* and 9*a*. Therefore, there is a limit in reducing the production cost.

SUMMARY OF THE INVENTION

It is therefore an object of the present invention to provide a throttle valve controller for an internal combustion engine which makes it possible to improve the engagement accuracy of a ring gear and reduce costs at the same time.

According to a first aspect of the present invention, there is provided a throttle valve controller for an internal combustion engine, which has a gear mechanism consisting of a sun gear for transmitting the revolution of an output shaft to the valve shaft of a throttle valve, an internal tooth type ring gear and an epicyclic gear to be engaged with these gears in internal space formed by arranging the valve housing of the throttle valve for controlling the amount of intake air for an internal combustion engine and the motor housing of a motor for revolving the output shaft in accordance with the operation amount of an accelerator to face each other, wherein the ring gear comprises a core body having rigidity and a tooth portion molded of a synthetic resin and integrated with the core body.

According to a second aspect of the present invention, there is provided a throttle valve controller for an internal combustion engine, wherein the core body is made from a metal.

According to a third aspect of the present invention, there is provided a throttle valve controller for an internal combustion engine, wherein the core body is formed by drawing.

According to a fourth aspect of the present invention, there is provided a throttle valve controller for an internal combustion engine, wherein the core body and the tooth portion are integrated with each other by charging a molding material for the tooth portion and solidifying it after the core body is placed in the molding space of a molding tool for the tooth portion.

According to a fifth aspect of the present invention, there is provided a throttle valve controller for an internal combustion engine, wherein the core body has a center hole portion for connecting it to the sun gear concentrically.

According to a sixth aspect of the present invention, there is provided a throttle valve controller for an internal combustion engine, wherein the core body has a peripheral wall to be brought into contact with the inner peripheral surface of the valve housing and the inner peripheral surface of the motor housing, both forming the internal space.

According to a seventh aspect of the present invention, there is provided a throttle valve controller for an internal combustion engine, wherein the core body has synthetic resin connecting means for the tooth portion.

According to an eighth aspect of the present invention, there is provided a throttle valve controller for an internal combustion engine, wherein the synthetic resin connecting means are through holes.

According to a ninth aspect of the present invention, there is provided a throttle valve controller for an internal combustion engine, wherein the tooth portion has an engagement portion in contact with the motor housing on the outer peripheral surface of the center hole portion of the core body.

According to a tenth aspect of the present invention, there is provided a throttle valve controller for an internal combustion engine, wherein the tooth portion has stopper portions for preventing the rotation of the ring gear in a circumferential direction when it is fitted into the valve housing or the motor housing.

The above and other objects, advantages and features of the present invention will become more apparent from the following description when taken into conjunction with the accompanying drawings.

BRIEF DESCRIPTION OF THE ACCOMPANYING DRAWINGS

DETAILED DESCRIPTION PREFERRED EMBODIMENTS

Embodiment 1

Figure 1:
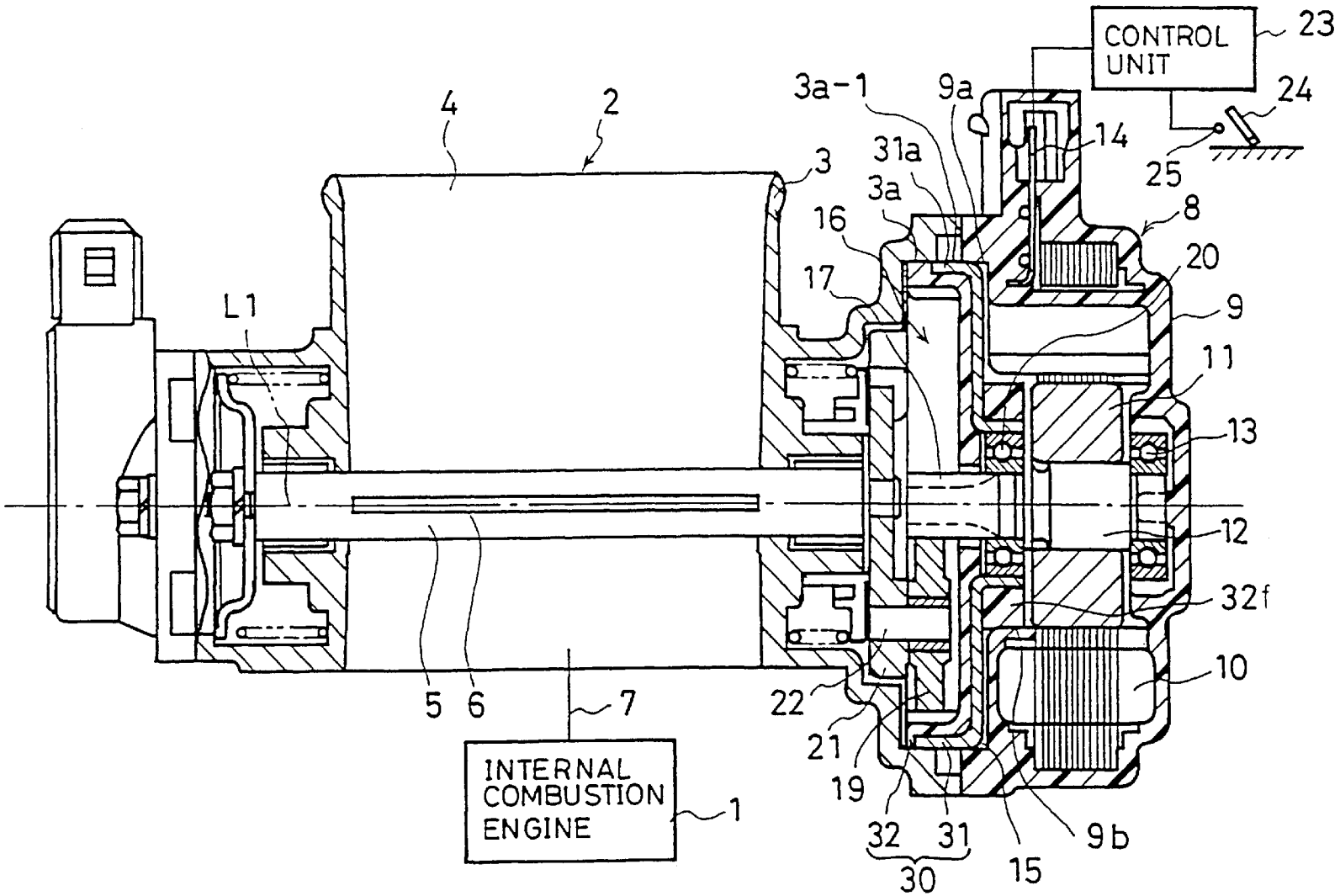
FIG. 1 is a partially cutaway side view of a throttle valve controller for an internal combustion engine according to Embodiment 1 of the present invention.
Figure 2:
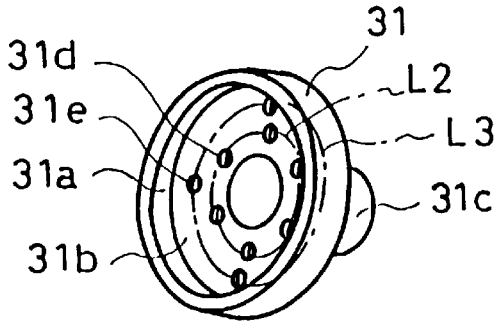
FIG. 2 is a perspective view of a core body according to Embodiment 1.
Figure 3:
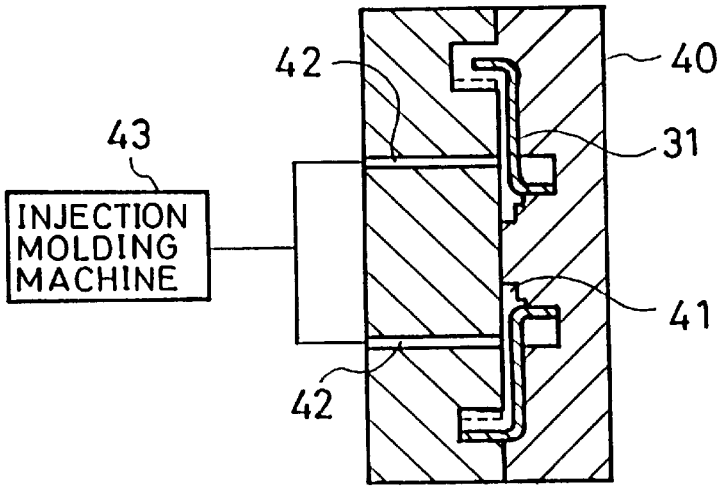
FIG. 3 is a sectional view showing the molding step of a ring gear according to Embodiment 1.
Figure 4:
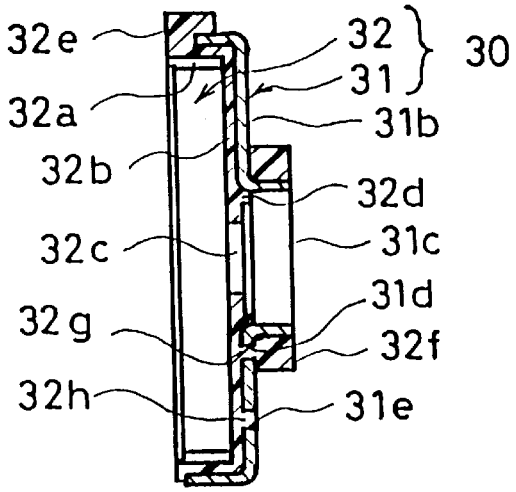
FIG. 4 is a sectional view cut on line A—A of FIG. 5.
Figure 5:
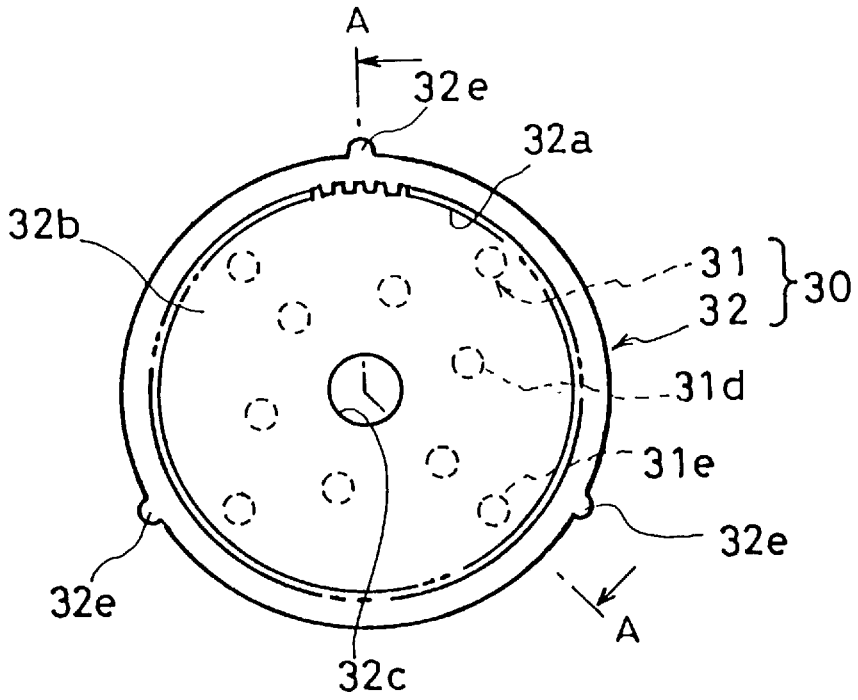
FIG. 5 is a front view of the ring gear according to Embodiment 1.
Figure 6:
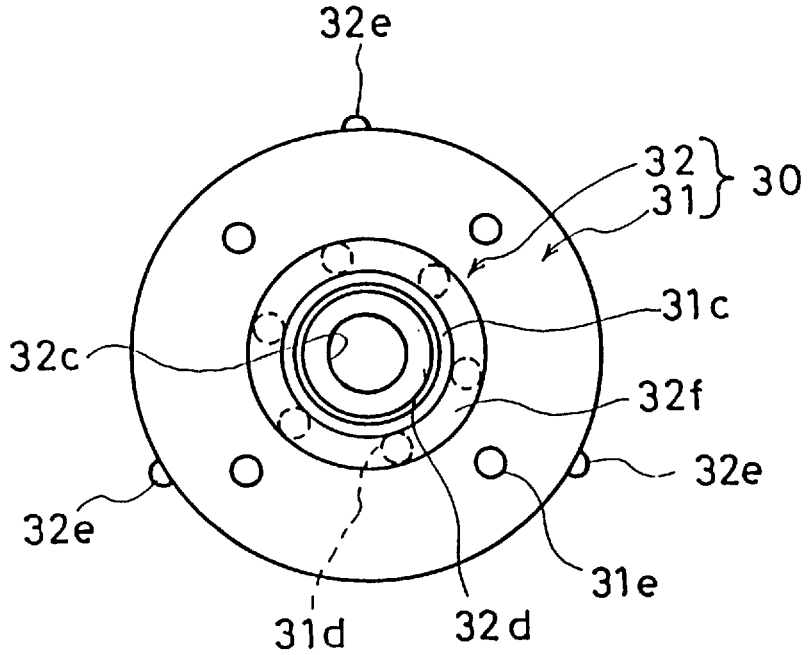
FIG. 6 is a rear view of the ring gear according to Embodiment 1.
Figure 7:
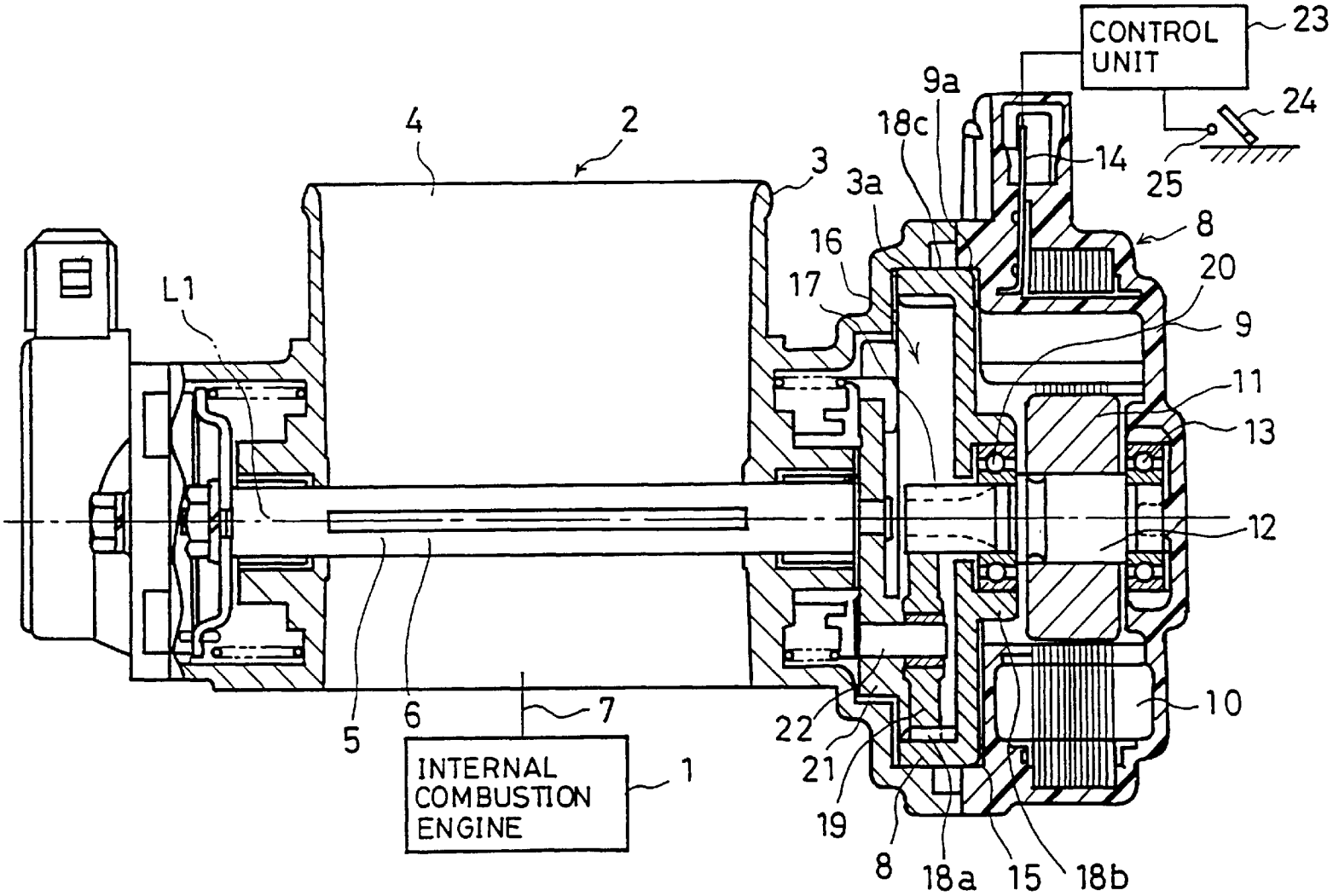
FIG.7 PRIOR ART
FIG. 7 is a partially cutaway side view of a throttle valve controller for an internal combustion engine of the prior art.

FIGS. 1 to 6 show Embodiment 1 of the present invention. FIG. 1 is a partially cutaway side view of a throttle valve controller for an internal combustion engine, FIG. 2 is a perspective view of a core body 31, FIG. 3 is a sectional view showing the molding step of a ring gear 30, FIG. 4 is a sectional view cut on line A—A of FIG. 5, FIG. 5 is a front view of the ring gear 30, and FIG. 6 is a rear view of the ring gear 30.

In FIG. 1, in embodiment 1 of the present invention, the ring gear 30 comprises a core body 31 having rigidity and a tooth portion 32 molded of a synthetic resin and integrated with the core body 31. Other constituent elements such as the internal combustion engine, throttle valve 2, valve housing 3, inlet passage 4, valve shaft 5, valve body 6, inlet pipe 7, motor 8, motor housing 9, stator 10, rotor 11, output shaft 12, bearing 13, terminal 14, internal space 15, sun gear 17 and epicyclic gear 19 of the gear mechanism 16, bearing 20, support body 21, support shaft 22, control unit 23, accelerator 24 and accelerator sensor 25 are the same as in the prior art.

As shown in FIG. 2, the core body 31 is formed by drawing a metal plate material to have a center hole portion 31*c* which projects toward the rear side in the center of a dish-like bottom portion 31*b* having a peripheral wall 31*a*. In the bottom portion 31*b*, a plurality of through holes 31*d* and 31*e* are formed around the center hole portion 31*c* at equal intervals in a circumferential direction on the circumferences L2 and L3 of two circles shown by virtual lines having different radii and concentric to the center hole portion 31*c*.

With reference to FIG. 3, the insert molding of the ring gear 30 using the core body 31 as an insert material will be described. After the core body 31 formed as shown in FIG. 2 is placed in the molding space 41 of a molding tool 40 which is a split tool, the molding tool 40 is closed. A synthetic resin material molten from an injection molding machine 43 is charged into the molding space containing the core body 31 through an injection hole 42 formed in the molding tool 40 and solidified. Then,the molding tool 40 is opened. In this state, a molded product corresponding to the ring gear 30 comprising the core body 31 and the tooth portion 32 integrated with the core body 31 shown in FIG. 4 is removed from the molding tool 40. In FIG. 3, the synthetic resin material to be charged into the molding space 41 and solidified is unshown to clarify illustration.

As shown in FIGS. 4 to 6, the tooth portion 32 of the ring gear 30 has an internal tooth portion 32*a*, surface portion 32*b*, through hole portion 32*c*, projecting portion 32*d*, stopper portions 32*e*, engagement portion 32*f*, bridge portion 32*g* and filling portion 32*h*. The internal tooth portion 32*a* is formed on the inner peripheral surface of the outer wall 31*a* of the core body 31. The surface portion 32*b* extends from the internal tooth portion 32*a* in contact with the front surface of the bottom portion 31*b* of the core body 31. The through hole portion 32*c* is formed in the center portion of the surface portion 32*b* to escape the sun gear 17. The projecting portion 32*d* is formed annular around a connection portion between the bottom portion 31*b* and the center hole portion 31*c* of the core body 31 at the back of the through hole portion 32*c* to contact the outer ring of the bearing 20. The stopper portions 32*e* are formed on the outer peripheral surface of the peripheral wall 31*a* of the core body 31 at equal intervals in a circumferential direction. The engagement portion 32*f* is formed annular in contact with the outer peripheral surface of the center hole portion 31*c* of the core body 31 and the back of the bottom portion 31*b* around the center hole portion 31*c*. The bridge portion 32*g* is formed by charging the synthetic resin material into the through holes 31*d* of the core body 31 and solidifying it to connect the surface portion 32*b* and the engagement portion 32*f*. The filling portion 32*h* is formed by charging the synthetic resin material into the through holes 31*e* of the core body 31 and solidifying it to project from the surface portion 32*b*.

With reference to FIG. 1, a description is given of the installation of the gear mechanism 16 consisting of the sun gear 17, the ring gear 30 and the epicyclic gear 19 in internal space 15 formed hermetically by the valve housing 3 and the motor housing 9 when the throttle valve 2 and the motor 8 formed as separate units are located adjacent to each other. While the sun gear 17 is provided concentric to the output shaft 12 and around the output shaft 12 which projects into the opening of the motor housing 9 from the motor housing 9, the center hole portion 31*c* of the ring gear 30 (see FIG. 4) is first fitted onto the bearing 20 which is further fitted onto the output shaft 12 located near the sun gear 17, the projecting portion 32*d* of the ring gear 30 (see FIG. 4) is brought into contact with the annular end face of the outer ring of the bearing 20, the ring gear 30 is fitted into the opening of the motor housing 9 in such a manner that the outer peripheral surface 31*a*-1 of the peripheral wall 31*a* (see FIG. 2) is in contact with the inner peripheral surface 9*a* of the opening, and part of the outer peripheral surface of the engagement portion 32*f* of the ring gear 30 is brought into contact with the hole wall surface 9*b* of a storing portion for rotatably storing the rotor 11 of the motor housing 9. The sun gear 17 which is formed separately from the output shaft 12 may be fixed to the output shaft 12 by engagement, or the teeth of the sun gear 17 may be formed on the outer peripheral surface of the output shaft 12. The epicyclic gear 19 is connected to the valve shaft 5 projecting into the opening of the valve housing 3 from the valve housing 3 through the support body 21 and the support shaft 22. In this state, an operator rotates the valve shaft 5 so that the valve body 6 is located either at the fully closed position for minimizing the cross section of the inlet passage 4 or at the fully open position for maximizing the cross section of the inlet passage 4.

Thereafter, the opening of the valve housing 3 and the opening of the motor housing 9 are arranged to face each other so as to form the internal space 15. In this case, the epicyclic gear 19 is engaged with the sun gear 17 and the ring gear 30 while it is inserted between the sun gear 17 and the ring gear 30. At the same time, the valve housing 3 is fitted onto the peripheral wall 31*a* of the ring gear 30 in such a manner that the inner peripheral surface 3*a* of the valve housing 3 is in contact with the outer peripheral surface 31*a*-1 of the peripheral wall 31*a*, and the end face of the opening of the valve housing 3 and the end face of the opening of the motor housing 9 are arranged to face each other. Thereby, the valve housing 3 and the motor housing 9 are fixed and prevented from moving in the radial direction of the valve shaft 5 and the radial direction of the output shaft 12 through the ring gear 30, respectively, the revolution center of the valve shaft 5 and the revolution center of the output shaft 12 are located concentric to each other on a single straight line Li shown by a one-dotted chain line and opposed to each other with space therebetween. The revolution center of the sun gear 17 provided concentric to the output shaft 12 and the revolution center of the valve shaft 5 are concentric to each other like the revolution center of the output shaft 12 and opposed to each other with space therebetween. In addition, the internal space 15 is formed hermetically. The gear mechanism 16 is installed in the internal space 15. Not shown in FIG. 1, to fit the valve housing 3 onto the ring gear 30, the stopper portions 32*e* shown in FIGS. 4 to 6 of the ring gear 30 are fitted in unshown recess portions formed in the inner peripheral surface 3*a* of the valve housing 3. Thereby, the rotation in a circumferential direction of the ring gear 30 is restricted. That is, the ring gear 30 is fixed in the valve housing 3 and the motor housing 9. After the gear mechanism 16 is installed in the internal space 15, the valve housing 3 and the motor housing 9 are connected to each other by unshown fixing tools such as bolts as shown in FIG. 1.

According to the constitution of this Embodiment 1, the ring gear 30 is arranged concentric to the sun gear 17 by the drawn center hole portion 31*c* of the metal core body 31 through the output shaft 12 of the motor 8 and the bearing 20, the core body 31 is fitted in the opening of the motor housing 9 in such a manner that the drawn peripheral wall 31*a* is in contact with the inner peripheral surface 9*a* of the opening, the valve housing 3 and the motor housing 9 are combined together to form the internal space 15 while the epicylic gear 19 is connected to the valve shaft 5 through the support body 21 and the support shaft 22 so that the epicyclic gear 19 is engaged with the sun gear 17 and the ring gear 30, the revolution center of the valve shaft 5 and the revolution center of the sun gear 17 are concentric and opposed to each other with a predetermined interval therebetween, the valve housing 3 and the motor housing 9 are properly fixed with the drawn peripheral wall 31*a* of the core body 31 interposed therebetween, and the center hole portion 31*c* of the core body 31 is properly fixed in the motor housing 9 by the engagement portion 32*f* molded of a synthetic resin of the ring gear 30. Therefore, the throttle valve controller for an internal combustion engine 1 which comprises the throttle valve 2, the motor 8 and the gear mechanism 16 is mounted on an automobile. Even when vibration is input into the throttle valve controller, the throttle valve 2, the motor 8 and the gear mechanism 16 do not shake independently, and the revolution of the output shaft 12 of the motor 8 is properly transmitted to the valve shaft 5 by the gear mechanism 16.

According to the constitution of this Embodiment 1, in the ring gear 30, the surface portion 32*b* formed on the front side of the core body 31 and connected to the internal tooth portion 32*a* of the tooth portion 32 and the engagement portion 32*f* formed on the rear side of the core body 31 are connected to each other by the bridge portion 32*g* formed as synthetic resin connecting means by charging a synthetic resin material into the through holes 31*d* and solidifying it. Therefore, the tooth portion 32 is firmly connected to the core body 31. Further, since the filling portion 32*h* is formed from the surface portion 32*b* of the tooth portion 32 on the core body 31 as synthetic resin connecting means by charging a synthetic resin material into the through holes 31*e* separate from the through holes 31*d* and solidifying it, the rotation of the tooth portion 32 with respect to the core body 31 can be properly prevented.

Further, according to the constitution of this Embodiment 1, since the ring gear 30 has the stopper portions 32*e* on the outer peripheral side, the rotation of the ring gear 30 can be properly prevented by fitting the stopper portions 32*e* in the unshown recess portions of the valve housing 3.

Embodiment 2

In the above Embodiment 1, the throttle valve 2 and the motor 8 are prevented from moving in the radial direction of the valve shaft 5 and the radial direction of the output shaft 12 through the ring gear 30. The peripheral wall 31*a* of the ring gear 30 may be separated from the motor housing 9 and the valve housing 3.

Embodiment 3

In the above Embodiment 1, the ring gear 30 is fixed. When the motor 8 is not driven, either one of the ring gear 30 and the support body 21 may be moved by an accelerator lever which moves together with the accelerator 24.

Embodiment 4

In the above Embodiment 1, the through holes 31*d* and 3*e* are formed as synthetic resin connecting means. The synthetic resin connecting means may be projections or projections formed by engraving the bottom portion 31*b*.

Embodiment 5

In the above Embodiment 1, the stopper portions 32*e* are engaged with the valve housing 3. The stopper portions 32*e* may be fitted in unshown recess portions formed in the motor housing 9, or the stopper portions 32*e* may be engaged with both the valve housing 3 and the motor housing 9.

As described above, according to the first aspect of the present invention, since the ring gear comprises a core body having rigidity and a tooth portion molded of a synthetic resin and integrated with this core body, costs can be reduced without changing the shape and weight of the ring gear and without reducing the engagement accuracy of the ring gear.

According to the second aspect of the present invention, since the core body is made from a metal, it is easy to acquire the core body.

According to the third aspect of the present invention, since the core body is formed by drawing, the engagement accuracy of the ring gear is improved.

According to the fourth aspect of the present invention, since the core body and the tooth portion are integrated with each other by charging a molding material for the tooth portion and solidifying it after the core body is placed in the molding space of a molding tool for the tooth portion, costs can be further reduced.

According to the fifth aspect of the present invention, since the core body has a center hole portion so that it can be connected to the sun gear concentrically, the ring gear and the sun gear can be arranged concentric to each other with ease.

According to the sixth aspect of the present invention, since the core body has a peripheral wall which is in contact with both the inner peripheral surface of the valve housing and the inner peripheral surface of the motor housing, both forming internal space, the throttle valve and the motor can be properly fixed and prevented from moving in the radial direction of the valve shaft and the radial direction of the output shaft through the ring gear.

According to the seventh aspect of the present invention, since the core body has synthetic resin connecting means for the tooth portion, integration between the core body and the tooth portion can be improved.

According to the eighth aspect of the present invention, since the synthetic resin connecting means are through holes, the size of the ring gear can be reduced.

According to the ninth aspect of the present invention, since the tooth portion has an engagement portion in contact with the motor housing on the outer peripheral surface of the center hole portion of the core body, the fixing of the ring gear in the motor housing can be improved.

According to the tenth aspect of the present invention, since the tooth portion has stopper portions for preventing the rotation of the ring gear in a circumferential direction when it is fitted in the valve housing or the motor housing, the ring gear can be properly fixed in the valve housing and the motor housing in such a manner that it is prevented from rotating in a circumferential direction.

What is claimed is:

1. A throttle valve controller for an internal combustion engine, the throttle valve controller comprising:

a sun gear for transmitting a rotational movement of an output shaft to a valve shaft of a throttle valve;

an internal tooth type ring gear provided around the sun gear; and an epicyclic gear engaged with the sun gear and the internal tooth type ring gear, the epicyclic gear adapted to revolve around the sun gear in accordance with an operation amount of an accelerator;

wherein the internal tooth type ring gear includes (1) a core body fabricated from a metal, and having a) a dish-shaped bottom portion, b) a peripheral wall extending from an outer periphery of the bottom portion, and c) a center hole portion provided on a center of the bottom portion, and (2) a molded synthetic resin integrated with the core body, and forming a tooth portion on an inward facing surface of the peripheral wall; and wherein the molded synthetic resin is formed by placing the core body in a molding space of a molding tool, injecting the synthetic resin into the molding space of the molding tool, and solidifying the synthetic resin.

2. The throttle valve controller for an internal combustion engine according to claim 1, wherein the core body is formed by drawing.

3. The throttle valve controller for an internal combustion engine according to claim 1, wherein the peripheral wall is in contact with an inner peripheral surface of a valve housing and an inner peripheral surface of a motor housing.

4. The throttle valve controller for an internal combustion engine according to claim 1, wherein the core body has synthetic resin connecting means for the tooth portion.

5. The throttle valve controller for an internal combustion engine according to claim 4, wherein the synthetic resin connecting means is a plurality of through holes that are filled with the molded synthetic resin.

6. The throttle valve controller for an internal combustion engine according to claim 1, wherein the molded synthetic resin includes an engagement portion that is (1) connected to the tooth portion, (2) provided on the outer peripheral surface of the center hole portion, and (3) in contact with a motor housing.

7. The throttle valve controller for an internal combustion engine according to claim 6, wherein the core body includes a through hole, and the molded synthetic resin extends through the through hole to connect the tooth portion and the engagement portion together.

8. The throttle valve controller for an internal combustion engine according to claim 7, wherein the core body includes a plurality of through holes.

9. The throttle valve controller for an internal combustion engine according to claim 1, wherein the tooth portion has stopper portions for preventing the rotation of the ring gear in a circumferential direction, the stopper portions fitting into at least one of a valve housing and a motor housing.

10. The throttle valve controller for an internal combustion engine according to claim 1, wherein the center hole portion extends from the center of the bottom portion.

* * * * *